United States Patent [19]

Vetter

[11] Patent Number: 4,932,791

[45] Date of Patent: Jun. 12, 1990

[54] ENVELOPE CLOSURE SEAL AND METHOD

[75] Inventor: Kurt W. Vetter, Long Island, N.Y.

[73] Assignee: Uniflex, Inc., Westbury, N.Y.

[21] Appl. No.: 350,460

[22] Filed: May 11, 1989

Related U.S. Application Data

[63] Continuation-in-part of Ser. No. 187,650, Apr. 28, 1988, abandoned.

[51] Int. Cl.[5] ..... B65D 33/14

[52] U.S. Cl. ..... 383/93; 383/5; 383/40

[58] Field of Search ..... 383/5, 38, 39, 40, 93, 383/95; 229/80; 206/610

[56] References Cited

U.S. PATENT DOCUMENTS

| | | | |
|---|---|---|---|
| 2,483,604 | 10/1949 | Abramson | 229/80 X |
| 2,597,305 | 5/1952 | Doyle | 383/93 X |
| 2,819,010 | 1/1958 | Amiguet | 229/80 X |
| 2,991,001 | 7/1961 | Hughes | 383/93 X |
| 3,456,867 | 7/1969 | Repko | 383/93 X |
| 3,625,414 | 12/1971 | Caiola | 383/93 |
| 3,669,254 | 6/1972 | Chrysanthis | 383/93 X |
| 3,680,768 | 8/1972 | Warren | 383/40 |
| 3,979,051 | 9/1976 | Close | 383/40 X |
| 4,709,396 | 11/1987 | Voshall et al. | 229/80 X |
| 4,709,397 | 11/1987 | Voshall et al. | 229/80 X |
| 4,744,673 | 5/1988 | Nakamura | 383/38 |
| 4,744,674 | 5/1988 | Nocek | 383/63 |
| 4,759,643 | 7/1988 | Canno | 206/610 X |

FOREIGN PATENT DOCUMENTS

| | | | |
|---|---|---|---|
| 1282028 | 12/1961 | France | 383/93 |
| 2009707 | 6/1979 | United Kingdom . | |
| 2032882 | 5/1980 | United Kingdom | 383/5 |
| 2145997 | 4/1985 | United Kingdom | 383/5 |

*Primary Examiner*—Stephen Marcus
*Assistant Examiner*—Nova Stucker
*Attorney, Agent, or Firm*—Robert F. Ziems

[57] ABSTRACT

A closure seal and method for envelopes having front and back panels joined along bottom and side edges and in which a release liner strip delimits overlying marginal edges along the top of the panels. The liner strip initially covers a pressure sensitive adhesive band in the top marginal edge of one of the panels and extends through the side edge junctures of the panels to enable removal of the liner strip and securement of the top margins by the pressure sensitive adhesive band. Registered lines of perforations are formed across the top portion of both panels below the bottom edge of the release liner strip to define a tear line for opening the envelope after it has been sealed in embodiments not intended for liquid contents. The lines of perforations are omitted in a liquid containing envelope embodiment wherein the adhesive band joins with fused side edges of the envelope.

18 Claims, 5 Drawing Sheets

ENVELOPE CLOSURE SEAL AND METHOD

CROSS-REFERENCE TO RELATED APPLICATION

This application is a continuation in part of co-pending application Ser. No. 07/187,650, filed Apr. 28, 1988, now abandoned.

BACKGROUND OF THE INVENTION

This invention relates to closable bags and envelopes and, more particularly, it concerns an improved closure sealing arrangement for envelopes of the type in which a narrow band of pressure sensitive adhesive, initially covered by a releasable liner strip, is effective to seal opposing panel surfaces at the opening through which the envelope is filled.

Envelopes formed from pliable thermoplastic sheet materials have become increasingly popular for use by courier service organizations to package documents and other items to be shipped usually on an expedited basis. Such envelopes are especially suited to this use because of the relatively high strength of the plastic sheet material, resistance to damage by water and other liquids, imperviousness to moisture generally and because of the ability of the sheet material to be printed in a wide range of distinguishing colors and styles. Additionally, the plastic sheet materials of such envelopes are receptive to a variety of pressure sensitive adhesives by which a strong and secure sealed closure of the envelope may be effected after it is filled.

Typically, plastic courier envelopes are formed by transversely severing and heat sealing overlying portions of a continuous longitudinally folded plastic web. In this way, the bottom of the envelope is formed by a fold in the continuous web whereas side edges of the envelope are defined by heat fusion lines securing front and back panels of the envelope. A closure flap is typically provided by folding the web of a line displaced from the transverse center thereof and so that the open top end of the envelope rear panel projects past the top edge of the front envelope panel as a rectangular flap to be folded back on and adhered to the front face of the envelope front panel. That portion of the web resulting in the closure flap is provided with a continuous strip of pressure sensitive adhesive covered by a continuous liner strip of material which releases easily from the adhesive. The liner strip is severed from the web with the remainder of the envelope during severance along the heat fusion lines aforementioned.

A major problem associated with flap closures of the type described in the environment of courier envelopes is that the adhesive strip is spaced substantially from the top edge of the envelope front panel. Thus, while the flap may be securely attached in its closed condition over the front envelope panel, no sealing occurs along the edges of the flap with the result that substantial openings are left at the top corners of the closed envelope. In addition, the pliable nature of the plastic material from which the envelope is formed requires the person who closes the flap to secure the strip of pressure sensitive adhesive in a final closed position over the front wall of the envelope. In so doing, the material offers no assistance to the operator in reaching the closed position of the flap as would occur, for example, in a paper envelope or an envelope made of relatively rigid material where a fold line tends to guide the flap into its closed position. Accordingly, there is a need for an improvements in closure seal arrangements for envelopes of the type referred to.

SUMMARY OF THE INVENTION

In accordance with the present invention, the problems associated with flap closures in envelopes of the type described are substantially overcome by an envelope closure and method by which the inner surfaces at the top of overlying envelope panels are secured directly by a band of pressure sensitive adhesive initially covered by a liner strip which is easily removed from its location between such inner surfaces.

The invention is particularly though not exclusively adapted to envelopes formed from a folded web of thermoplastic material from which the envelopes are severed to provide heat fused side edges. In this respect, the invention is practiced by providing a continuous layer of pressure sensitive adhesive in the shape of a narrow band along one marginal edge of a folded plastic web and covering the adhesive band with a continuous liner strip of material, such as silicone coated polyethylene or paper, which is releasable from the adhesive. The liner strip also prevents heat fusion of thermoplastic sheet material through the thickness of the strip. In the finished envelope, the liner strip projects from the top opening between the overlying envelope panels and extends through the otherwise heat sealed side edges thereof but, because of the fusion inhibiting nature of the liner strip material, the liner strip is easily separated from the top margins of the panels.

To seal the envelope, the liner strip is removed from between the inner surfaces of the top marginal edges of the overlying panels, allowing the pressure sensitive adhesive band on one of such edges to contact and adhesively secure to the other. In embodiments intended for contents which do not require a complete liquid-proof enclosure, the envelope is opened by tearing both adhesively secured top margins from the remainder cf the envelope along registered lines of perforations in both front and rear panels. Where the envelope is intended for liquid contents or contents to be completely sealed from the atmosphere, access to the contents requires cutting or otherwise rupturing the material of the envelope.

Accordingly, a principal object of the present invention is to provide an easily manipulated and secure adhesively sealed closure for envelopes. Another and more specific object of the invention is the provision of a closure seal and method for envelopes formed from a continuous folded web of thermoplastic material. A further object of the invention is the provision of an envelope closure seal construction and method for its formation by which the containment requirements of a variety of envelope contents may be accommodated. Other objects and further scope of applicability of the present invention will become apparent from the detailed description to follow taken in conjunction with the accompanying drawings in which like parts are designated by like reference characters.

DETAILED DESCRIPTION OF THE PREFERRED EMBODIMENTS

Figure 1:
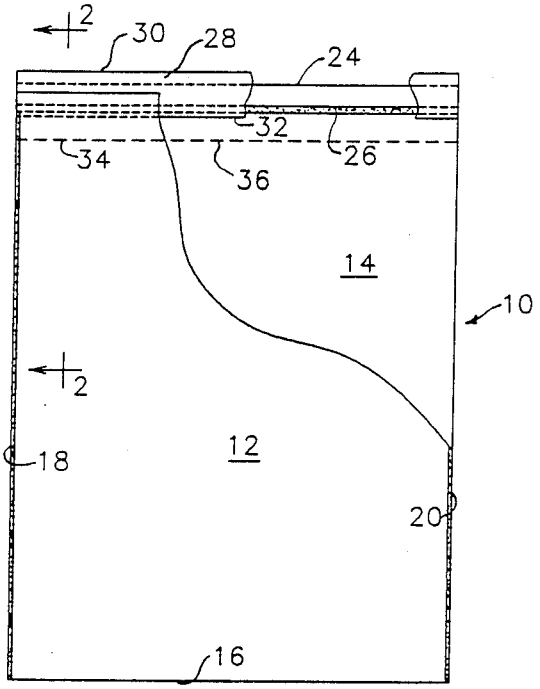
FIG. 1 is a partially cut-away front elevation illustrating one envelope embodiment of the present invention.
Figure 2:
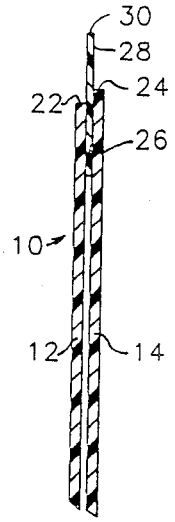
FIG. 2 is an enlarged fragmentary cross section on line 2—2 of FIG. 1.

In FIGS. 1 and 2 of the drawings, an envelope incorporating the closure arrangement of the present invention is generally designated by the reference numeral 10 and shown to include coextensive front and back or otherwise overlying panels 12 and 14, respectively. The panels 12 and 14 are joined at the bottom of the envelope 10 by a linear fold 16 and at their side edges by fusion lines 18 and 20. The top edges of the panels 12 and 14, designated by the reference numerals 22 and 24 respectively, extend for the full width of the envelope and are initially unsecured along the full length thereof to provide a top opening for access to the interior of the envelope. In this respect, it will be noted also that the back panel 14 of the envelope 10 is slightly longer than the front panel 12 so that the top edge 24 of the panel 14 extends slightly beyond the top edge 22 of the front panel 12.

A continuous band of pressure sensitive adhesive 26 is coated on the back panel 14 near the upper edge 24 thereof but spaced sufficiently from the edge 24 so that such spacing, coupled with the width of the adhesive band, results in the complete adhesive band lying under the front panel 12 below the top edge 22 of the front panel. A release liner strip 28 initially separates the adhesive band 26 from the inner surface of the front panel 12 and extends throughout the length of the top edges 22 and 24 of the envelope 10. As may be seen in FIGS. 1 and 2, the releasable liner strip 28 is of a width between top and bottom edges 30 and 32 to extend slightly below the adhesive band 26 and beyond the top edge 24 of the back panel 14. Finally, the front and rear panels are provided with registered lines 34 and 36, respectively of perforations to define a tear line for opening the envelope after it has been sealed in a manner to be described in more detail below.

Figure 5:
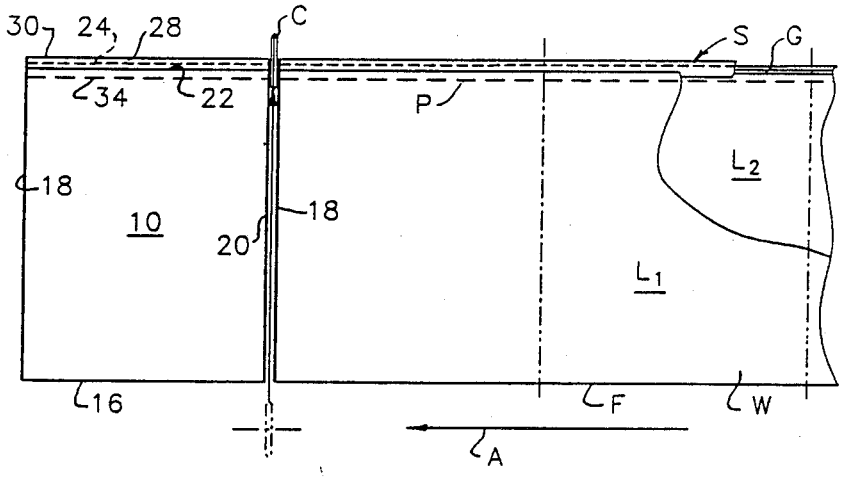
FIG. 5 is a largely schematic plan view illustrating the manner in which the envelope embodiment of FIGS. 1-4 is formed.

Because the construction of the envelope 10 illustrated in FIG. 1 is dictated in substantial part by the materials and method used to form the envelope, reference is made to FIG. 5 of the drawings in which the final steps in the formation of the envelope 10 are depicted. As shown, a web (W) of thermoplastic material and having a width equal to the combined heights (the distance between the bottom fold 16 and the top edges 22,24 in FIG. 1) of the panels !2 and 14 is folded along its length on a line (F) to establish overlying front and back layers ($L_1$) and ($L_2$) and fed in increments corresponding to the common widths of the panels 12 and 14 toward a cutter (C) in the direction indicated by an arrow (A). The web (W) is either preformed with or perforated after folding at a point upstream from the portion shown in FIG. 5 to provide a continuous line of perforations (P) through both folded layers ($L_1$) and ($L_2$). Similarly, a continuous band (G) of pressure sensitive adhesive is formed on the back layer ($L_2$) near the free edge thereof and the adhesive covered by a continuous release liner strip (S). During a dwell in the longitudinal feed of the folded web (W), the cutter (C), which is heated, traverses the width of the folded web to sever the envelope 10 therefrom. During this severing step, the fusion line 20 is formed on the finished envelope 10 and, at the same time, the fusion line 18 is formed on the next envelope to be severed from the folded web (W). It is to be noted that while the cutter (C) is depicted as a traversing circular cutting knife in the exemplary process embodiment depicted in FIG. 5, a non-traversing reciprocating heated cutter in the form of a heated blade or wire may be used in place of the cutter (C).

An important feature of the present invention is that the connection of the panels 12 and 14 along the side edges of the envelope 10, represented by the fusion lines 18 and 20 in the illustrated embodiment, terminate at or are discontinued at the bottom edge 32 of the release liner strip 28 so that the strip 28 delimits an unconnected or free top marginal portion in both panels 12 and 14. As a result, the front panel 12 in the illustrated embodiment may be folded away from the liner strip 28 and the top marginal portion of the back panel 14 throughout the width of the panels including the side edges thereof as shown most clearly in FIG. 3 of the drawings. This characteristic in the envelope 10 is preferably attained by forming the release liner strip 28 of material which, in addition to being easily releasable from the adhesive band 26, prevents the formation of the fusion lines 18 and 20 during severance of the finished envelope from the web (W). For example, where the release liner strip 22 is formed from high density polyethylene coated with silicone on one surface to enable its release from the pressure sensitive adhesive band 26, it is additionally provided with a silicone coating on the side facing the front panel 12. As a result of the silicone coating on both sides, heat fusion of the panels 12 and 14 is prevented over the width of the liner strip 28. Alternatively, the strip 28 may be formed of paper coated with silicone on only one side to enable release of the liner strip from the adhesive. A material such as paper will also prevent the formation of a fusion line through both layers of the plastic material forming the panels 12 and 14.

The use of a silicone coating as a release agent to enable separation of the liner strip 28 from the adhesive band 26 is especially effective for use with adhesives which adhere strongly on contact with thermoplastic sheet material such as polyethylene or polypropylene. An example of such an adhesive is a hot melt glue marketed by National Starch and Chemical Corporation, New York, N.Y. under the registered trademark "DURO-TAK". It is contemplated, however, that other combinations of specific adhesives, sheet materials, and release agents for the liner strip 28 may be used without departing from the present invention.

As described above with reference to FIG. 1, the bottom edge 32 of the liner strip 28 is located slightly below the adhesive band 26. In practice, the distance between the bottom edge 32 of the strip and the bottom edge of the adhesive band 26 may be kept as small as approximately ⅛ inch. As a result, the fusion lines 18 and 20 will extend to approximately ⅛ inch from the lower edge cf the adhesive band 26.

Figure 3:
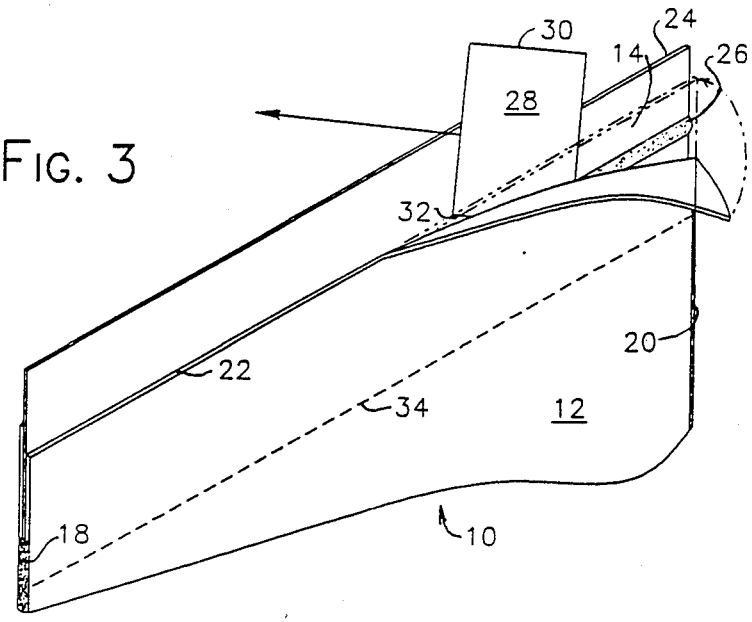
FIG. 3 is a fragmentary perspective view depicting closure of the envelope shown in FIG. 1.
Figure 4:
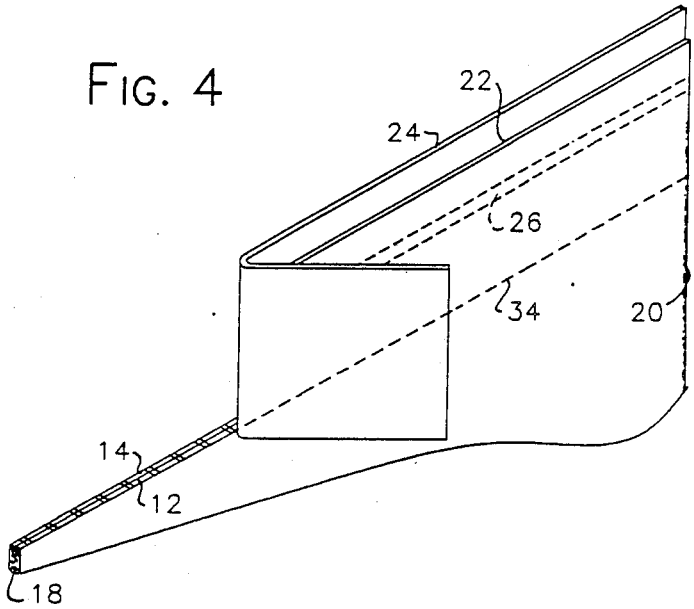
FIG. 4 is a fragmentary perspective view illustrating the opening of the envelope closure embodiment shown in FIGS. 1-3.

As shown in FIG. 3, the upper marginal portions of the panels 12 and 14 may be sealed simply by folding back the upper marginal portion of the panel 12 to render accessible the bottom edge 32 at one end of the strip 28. The strip 28 is then peeled back away from the adhesive band 26 and the folded back top marginal portion of the panel 12 allowed to resume its original position at which the pressure sensitive adhesive 26 will secure it firmly to the panel 14. Because of the proximity of the adhesive band 26 to the lower edge 32 of the liner strip 28 and, correspondingly, to the tops of the fusion lines 18 and 20, the envelope will be virtually sealed except for a space of about ⅛ inch between the tops of the fusion lines 18 and 20 and the band 26 of pressure sensitive adhesive. To open the envelope and as shown in FIG. 4 of the drawings, the upper portions of both panels 12 and 14 are pulled from the remainder of the envelope 10 along the registered perforated lines 34 and 36 positioned below the adhesive band 26.

While peeling the liner strip 28 lengthwise as depicted in FIG. 3 results in a neat progressive closure across the full width of the envelope, the liner may be pulled directly from the adhesive 26. This latter technique is facilitated by increasing the width of the liner strip 28 to about two inches. This wider strip extends beyond the upper edges 22 and 24 of the panels 12 and 14 by about 1½ inches and as such provides a hand hold. By gripping the base of the envelope in one hand, gripping the midportion of the protruding portion of the wider liner strip in the other hand, and, then, abruptly pulling on the liner strip, the liner strip is snapped out of the envelope 10. With the liner strip removed, the band of pressure sensitive adhesive 26 secures the upper marginal portions together and seals the envelope 10.

Figure 7:
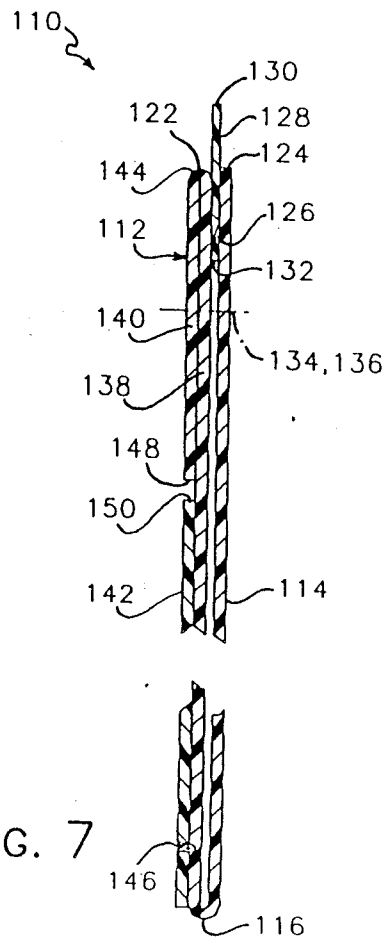
FIG. 7 is an enlarged cross section on line 7—7 of FIG. 6.
Figure 6:
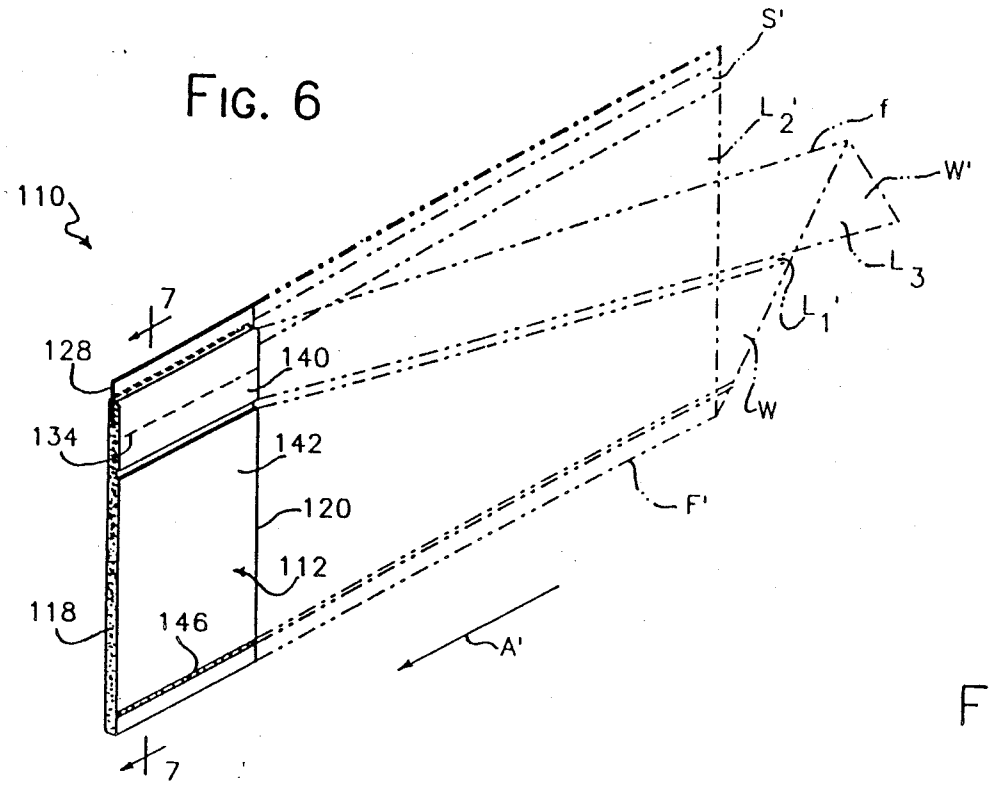
FIG. 6 is a schematic perspective view illustrating another envelope embodiment of the present invention and its formation.

In FIGS. 6 and 7 of the drawings, an alternative envelope embodiment incorporating the closure arrangement of the present invention is depicted with reference characters corresponding to those of FIGS. 1–5 but with the reference numerals being increased by 100 and the references letters being primed. Thus, an envelope, generally designated by the reference numeral 110, is shown to include coextensive first and second panels 112 and 114, respectively. The first panel 112 is made up of an inner layer 138 and an outer layer having an upper section 140 and a lower section 142. The inner layer 138 and the upper section 140 are joined at the top of the envelope 110 by a linear fold 144 which defines the top edge 122 of the first panel 112 and at their coextensive side edges by fusion lines 118 and 120. The inner layer 138 and the lower section 142 are joined near the bottom of the envelope 110 by a fusion line 146 and along their coextensive side edges by fusion lines 118 and 120. A bottom edge 148 of the top section 140 and a top edge 150 of the bottom section 142 extend for the full width of the envelope and are unsecured along the full length thereof to provide an opening for access to the interior of a pocket established between the inner and outer layers of the first panel 112 with the top section 140 serving as a closure flap.

Because the construction of the envelope 110 illustrated in FIGS. 6 and 7, like the embodiment of FIGS. 1–5, is intended to facilitate a method used to form the envelope, reference is made to FIG. 6 of the drawings in which the final steps in the formation of the envelope 110 are depicted in phantom lines. As shown, the web (W') of thermoplastic material having a width equal to the combined heights (the distance between the bottom fold 116 and the top edges 122 and 124 in FIG. 7) of the panels 112 and 114 plus the vertical dimension of the upper section 140 (the distance between the bottom edge 148 and the top edge 122 in FIG. 7) is folded along its length on a first line (F') and along a second line (f) to establish a front layer ($L_3$), and intermediate layer ($L_1'$), and a back layer ($L_2'$). An additional linear web (w) of thermoplastic material is fused to the lower portion of the intermediate layer ($L_1'$) and the combined assembly of the two webs (W') and (w) is fed in increments corresponding to the common widths of the panels 112 and 114 toward a cutter in the direction indicated by the arrow (A'). The web (W') is either perforated with or perforated after folding at a point upstream from the cutting station to provide a continuous line of perforations through the folded layers ($L_1'$), ($L_2'$), and ($L_3$). Similar to the formation of the envelope 10 shown in FIG. 5, a continuous band of pressure sensitive adhesive is formed on the back layer ($L_2'$) near the free edge thereof and the adhesive is covered by a continuous release liner strip (S'). During a dwell in the longitudinal feed of the folded web assembly, the cutter, which is heated, traversed the width of the folded web assembly to sever the envelope 110 therefrom. During the severing step the fusion line 120 is formed on the finished envelope 110 and, at the same time, the fusion line 118 is formed on the next envelope to be severed from the folded web assembly.

The connection of the panels 112 and 114 along the side edges of the envelope 110, represented by the fusion lines 118 and 120 in the embodiment illustrated in FIGS. 6 and 7, terminate at the bottom edge 132 of the release liner strip 128. The strip 128 delimits an unconnected or free top marginal portion in both panels 112 and 114 because the release liner strip 128 is of a material which, in addition to being easily releasable from the adhesive band 126, prevents the formation of the fusion lines 118 and 120 during severance of the finished envelope from the folded web assembly. The upper marginal portions of the panels 112 and 114 may be sealed in the manner described above with respect to sealing the envelope 10. To open the envelope 110, both top edges of the panels 112 and 114 are torn away from the remainder of the envelope along the tear line defined by the registered perforation lines 134, 136. In so doing, both the interior of the envelope, that is, the area between the first and second panels 112 and 114 and the pocket located between the inner layer 138 and the outer layer 110 of the panel 112, are simultaneously opened.

Figure 8:
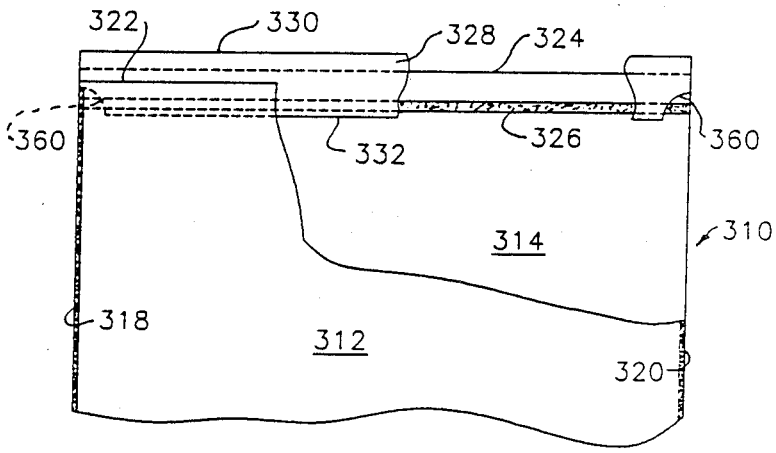
FIG. 8 is a partially cut-away and fragmentary front elevation illustrating a still further embodiment of the invention.
Figure 9:
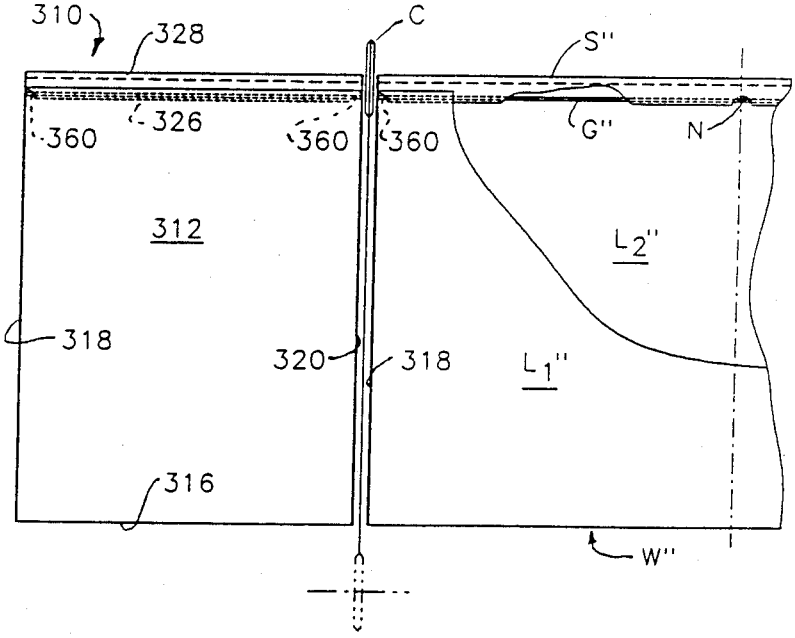
FIG. 9 is schematic plan view in the style of FIG. 5 but depicting formation of the embodiment shown in FIG. 8.
Figure 10:
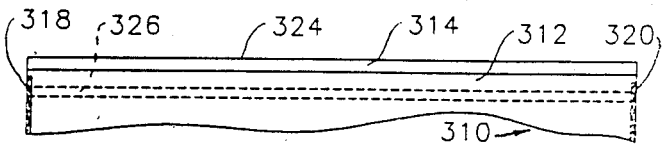
FIG. 10 is a fragmentary front elevation of the embodiment of FIG. 8 after closure.

In FIGS. 8–10 of the drawings, a further alternative embodiment of the invention is illustrated in which parts corresponding to the embodiment of FIGS. 1–5 are identified by reference numerals having the same tens and digits values but in a three hundred series. Thus, in FIG. 8, an envelope 310 is shown to include a pair of overlying panels 312 and 314 secured along their side edges by fusion welds 318 and 320. A band of pressure sensitive adhesive 326 again extends across the upper portion of the panel 314 and is spaced inwardly from the top edge 324 of that panel sufficiently so that the adhesive band 326 lies below the top edge 322 of the other panel 312. A release liner strip 328 is initially positioned between the panels 312 and 314 along the upper edges thereof and positioned to overlie the adhesive band 326 to allow the top edge 22 of the panel 312 to be opened away from the panel 314 for envelope filling.

The embodiment of FIGS. 8–10 differs from the previously described embodiments in that the band of pressure sensitive adhesive 326 extends through and thus joins with the upper ends of the fusion lines 318 and 320 at the side edges of the panels 312 and 314. As a result and as illustrated in FIG. 10, when the envelope 310 is sealed by removal of the strip 328 in the manner described above and the front panel is pressed against the adhesive band 326, a complete liquid-proof closure of the envelope interior is obtained. Thus, the envelope 310 may be used to contain various types of liquids, foods, or o&her materials in which a complete sealed enclosure is required.

The juncture of the adhesive band 326 with both fusion lines 318 an 320 on opposite sides of the envelope 310 is achieved by providing the ends of the release liner strip 328 with notches 360 extending from the bottom edge of the strip 328 to the opposite ends thereof. As a result of this construction, the panels 312 and 314 are initially secured to each other by the adhesive in the regions of the notches 360 or at the ends of the opening through which the panels 312 and 314 are filled. When the strip 328 is removed, the remainder of the two panels 312 and 314 become secured continuously along the band 326.

The notches 360 in the release liner strip 328 also contribute to the extension of the fusion lines 318 and 320 upwardly past the adhesive band 326 as may be appreciated from FIG. 9 of the drawings. In particular, it will be noted that the web (W) from which the envelope 310 is formed is assembled with the strip (S″) in a manner so that semicircular notches (N) along the lower edge of the strip (S″) register with the cutting line along which the successive envelopes like the envelope 310 are severed from the web (W). Because the fusion lines 318 and 320 are terminated during the manufacturing process by the material of the release liner strip (S″), the tops of the fusion lines are extended past the bottom edge of the strip (S″) to the bases of the notches (N).

From the foregoing description of alternative embodiments of the invention, it will be seen that with a minor variation of solely the release liner strip (S), (S′), (S″), the envelope closure of the invention may be adapted to accommodate content materials for which a slightly vented closure is desirable, such as documents, medical specimen vials, and other solid materials, and materials such as food or liquids which require a completely liquid-proof closure. In the embodiment of FIGS. 1–5, for example, the slight spacing of the adhesive band 26 beyond the top ends of the fused side edges 18 and 20, as delimited by the liner strip 28, provides a pair of small vents on opposite top corners of the envelope through which unwanted air may be released from the envelope after closure. Such venting is desirable in many courier envelope applications. On the other hand, the embodiment of FIGS. 8–10 enables containment of liquid contents in the envelope 310 with no modification of envelope structure other than the liner strip 328.

Thus it will be appreciated that as a result of the present invention, a highly effective envelope closure and method is provided by which the stated objects and others are completely fulfilled. It is contemplated and will be apparent to those skilled in the art from the foregoing description and accompanying drawing illustrations that variations and/or modifications of the disclosed embodiments may be made without departure from the invention. Accordingly, it is expressly intended that the foregoing description and accompanying drawings are illustrative of a preferred embodiments only, not limiting, and that the true spirit and scope of the present invention be determined by reference to the appended claims.

I claim:

1. In an envelope including at least two overlying panels of pliable thermoplastic material, each of said panels having a bottom edge, two side edges and a top edge, said panels being joined one to the other along said bottom edge, fused one to the other at said side edges and open along said top edge for access to the envelope interior, each of said two side edges lying on a single line throughout the length thereof, an improved closure seal comprising:

a release liner strip positioned between said panels at the top edges thereof and, said liner strip having opposite ends and a bottom edge to delimit a top marginal area in each of said panels and extending for the width of said panels so that the opposite ends of said liner strip are colinear with the lines of said side edges;

a pressure sensitive adhesive layer extending continuously between said side edges across said top marginal area of one of said panels, said adhesive layer underlying at least the major central portion of said release liner strip between the opposite ends thereof and the top marginal area of the other of said panels;

whereby removal of said release liner strip from between the top marginal areas of the panels results in an adhesive closure extending continuously between the side edges of said panels, said release liner strip being of a width to extend beyond the top edges of both said panels to facilitate removal thereof for sealing the top edges of said panels.

2. The envelope recited in claim 1, wherein said pressure sensitive adhesive layer is delimited by a lower edge located approximately ⅛ inch from the bottom edge of said liner strip.

3. The envelope recited in claim 1, wherein at least one of said panels includes a plurality of layers.

4. The envelope recited in claim 3, wherein said plurality of layers form a pocket.

5. The envelope recited in claim 4, wherein one of said layers of said multilayered panel is formed of separate upper and lower portions with the upper portion serving as a closure flap and the separation providing access to the pocket.

6. The envelope recited in claim 5, including registered lines of perforations across the upper portion of said panels and spaced beneath the bottom edge of said liner strip.

7. The envelope recited in claim 6, wherein the perforations extend through at least two of the layers of said multilayered panel.

8. The envelope recited in claim 1, wherein said adhesive layer underlies said release liner strip completely between the opposite ends thereof thereby to prevent contact of any portion of said other panel with said adhesive layer until said liner strip is removed.

9. The envelope recited in claim 8, wherein fusion of said panels at said side edges terminates at the bottom edge of said release liner strip, thereby to provide a space between the terminated ends of the fused side edges and said adhesive layer.

10. In an envelope including at least two overlying panels of pliable thermoplastic material, each of said panels having a bottom edge, two side edges and a top edge, said panels being joined one to the other along said bottom edge, fused one to the other at said side edges and open along said top edge for access to the envelope interior, each of said two side edges lying on a single line throughout the length thereof, an improved closure seal comprising:

a release liner strip positioned between said panels at the top edges thereof and, said liner strip having opposite ends and a bottom edge to delimit a top marginal area in each of said panels and extending for the width of said panels so that the opposite ends of said liner strip are colinear with the lines of said side edges;

a pressure sensitive adhesive layer extending continuously between said side edges across said top marginal area of one of said panels, said adhesive layer underlying at least the major central portion of said release liner strip between the opposite ends thereof and the top marginal area of the other of said panels, said pressure sensitive adhesive layer being configured as a linear narrow band located near the bottom edge of said liner strip;

whereby removal of said release liner strip from between the top marginal areas of the panels results in an adhesive closure extending continuously between the side edges of said panels.

11. In an envelope including at least two overlying panels of pliable thermoplastic material, each of said panels having a bottom edge, two side edges and a top edge, said panels being joined one to the other along said bottom edge, fused one to the other at said side edges and open along said top edge for access to the envelope interior, each of said two side edges lying on a single line throughout the length thereof, an improved closure seal comprising:

a release liner strip positioned between said panels at the top edges thereof and, said liner strip having opposite ends and a bottom edge to delimit a top marginal area in each of said panels and extending for the width of said panels so that the opposite ends of said liner strip are colinear with the lines of said side edges, the fusion of said panels at said side edges extending from said bottom edges of said panels to upper ends delimited by said liner strip;

a pressure sensitive adhesive layer extending continuously between said side edges across said top marginal area of one of said panels, said adhesive layer underlying at least the major central portion of said release liner strip between the opposite ends thereof and the top marginal area of the other of said panels;

whereby removal of said release liner strip from between the top marginal areas of the panels results in an adhesive closure extending continuously between the side edges of said panels.

12. The envelope recited in claim 11, wherein said liner strip is polyethylene having a release coating on opposite sides thereof.

13. The envelope recited in claim 11, wherein said liner strip is paper having a release agent coating on at least one side thereof.

14. The envelope recited in either of claims 12 or 13, wherein said release agent coating comprises silicone.

15. The envelope recited in claim 11, including registered lines of perforations across the upper portion of said panels and spaced beneath the bottom edge of said liner strip.

16. In an envelope including at least two overlying panels of pliable thermoplastic material, each of said panels having a bottom edge, two side edges and a top edge, said panels being joined one to the other along said bottom edge, fused one to the other at said side edges and open along said top edge for access to the envelope interior, each of said two side edges lying on a single line throughout the length thereof, an improved closure seal comprising:

a release liner strip positioned between said panels at the top edges thereof and, said liner strip having opposite ends and a bottom edge to delimit a top marginal area in each of said panels and extending for the width of said panels so that the opposite ends of said liner strip are colinear with the lines of said side edges;

a pressure sensitive adhesive layer extending continuously between said side edges across said top marginal area of one of said panels, said adhesive layer underlying at least the major central portion of said release liner strip between the opposite ends thereof and the top marginal area of the other of said panels, the opposite ends of said adhesive layer joining with said fused side edges and adhering to said other panel while said release liner strip is positioned between said panels;

whereby removal of said release liner strip from between the top marginal areas of the panels results in an adhesive closure extending continuously between the side edges of said panels.

17. The envelope recited in claim 16, in which said release liner strip includes a notched portion at each of said opposite ends, said notched portion extending between said bottom edge of said liner strip and each of said opposite ends.

18. The envelope recited in claim 17, wherein said notched portions are quarter-circular in configuration.

* * * * *